US005720422A

United States Patent [19]

Ichikawa et al.

[11] Patent Number: 5,720,422

[45] Date of Patent: Feb. 24, 1998

[54] STAPLE TACKER WITH A STRIKING NOSE AND A STAPLE MAGAZINE

[75] Inventors: Kaoru Ichikawa, Hitachinaka; Akira Uno, Hitachioota, both of Japan

[73] Assignee: Hitachi Koki Co., Ltd., Tokyo, Japan

[21] Appl. No.: 617,152

[22] Filed: Mar. 18, 1996

[30] Foreign Application Priority Data

Apr. 7, 1995 [JP] Japan ..... 7-082848

[51] Int. Cl.[6] ..... B25C 1/04

[52] U.S. Cl. ..... 227/120

[58] Field of Search ..... 227/120, 130

[56] References Cited

U.S. PATENT DOCUMENTS 3,905,535 9/1975 Novak et al. ..... 227/120

4,326,661 4/1982 Maurer et al. ..... 227/120

4,801,062 1/1989 Austin ..... 227/120

*Primary Examiner*—Scott A. Smith

*Attorney, Agent, or Firm*—Pollock, Vande Sande & Priddy

[57] ABSTRACT

A nose 2 has a recessed portion 4 engageable with the front end of a magazine 3. A through-hole 12 is provided on each side wall of the recessed portion 4 of nose 2. The front end of magazine 3 is formed into a protruding portion 6 just fitting to or coupled into the recessed-portion 4 of nose 2. A through-hole 13 is opened across the protruding portion 6 of magazine 3 so that through-hole 13 meets through-holes 12 opened on the side walls of the recessed portion 4 when the magazine 3 is completely engaged with the nose 2. A pin 16 is inserted into the through-holes 12 and 13 to fix magazine 3 in the recessed portion 4 of nose 2. A resilient member 15 is provided between pin 16 and through-hole 13.

8 Claims, 3 Drawing Sheets

STAPLE TACKER WITH A STRIKING NOSE AND A STAPLE MAGAZINE

BACKGROUND OF THE INVENTION

1. Field of the Invention

The present invention generally relates to a staple tacker having a nose through which staples are struck on the flooring material or the like to fix it and a magazine storing staples, and more particularly to a-reliable support structure between the striking nose and the staple magazine.

2. Prior Art

A staple tacker, a handy machine used for fixing flooring materials, includes many parts made of resin for the reduction of overall weight. Especially, a staple magazine is one of key parts having a large size, since it is required to store sufficient and numerous staples therein. Accordingly, fabricating this staple magazine by resin is primarily important to realize the effective weight reduction of the staple tacker.

FIG. 4 shows one example of a conventional staple tacker. As shown in FIG. 4, a staple tacker body 1 has a lower part connected to a nose 2 used for striking staples. The nose 2 supports a magazine 3 storing numerous staples therein. More specifically, nose 2 includes a recessed or concave portion 4 and a screw portion 5 for securely fixing one end of magazine 3.

Magazine 3, made of resin, has a protruding or convex portion 6 to be engaged with the recessed or concave portion 4 of nose 2 and sleeves 8, made of steel, comprising rigid screw portions 7 therein.

A plate 9 is used to support the magazine 3 and nose 2 from the bottom. Fixation of magazine 3 to the nose 2 is accomplished by fastening or engaging several bolts 10 into screw portions 7 of steel sleeves 8.

However, the above-described conventional magazine support structure has the following problems.

The impact force generating in each striking operation of staples is chiefly received at the screw portions 5 and 7. Forming screw portions by the resin body of magazine 3 is not suitable in view of the strength or durability to be required to the screw portions under such impact forces.

This is why the steel sleeves 8 with rigid screw portions 7 are formed integrally with the resin body of magazine 3 for the purpose of reinforcement.

However, using steel sleeves 8 with rigid screw portions 7 brings various drawbacks. For example, the collection of classified refuse will require us to separate every steel part from resin materials. The necessity of inserting steel sleeves 8 into the resin body of magazine 3, for example, by molding or the like will considerably deteriorate the productivity of the parts. In addition, increase of the number of parts will raise the manufacturing costs, while lowering the efficiency in the disassembling and assembling operations.

SUMMARY OF THE INVENTION

Accordingly, in view of above-described problems encountered in the prior art, a principal object of the present invention is to provide a novel and excellent magazine support structure for a staple tacker capable of eliminating the above-described drawbacks, and facilitating the collection of classified refuse, as well as disassembling and assembling operations, and also reducing the costs significantly.

In order to accomplish this and other related objects, a first aspect of the present invention provides a novel and excellent magazine support structure for a staple tacker comprising: a nose extending from a main body of the staple tacker for guiding a staple; a magazine used for storing staples therein, having one end connected to the nose; a first engaging portion and a first through-hole formed on the nose; a second engaging portion and a second through-hole formed on the magazine, the second engaging portion being engaged with the first engaging portion of the nose, and the second through-hole meeting the first through-hole of the nose when the first engaging portion is engaged with the second engaging portion; and a pin detachably inserted into the first and second through-holes so as to fix the magazine to the nose.

According to the features of preferred embodiments, it is desirable that an elastic member is provided in at least one of the first and the second through-holes. The pin is inserted in a hole of the elastic member having a diameter smaller than a diameter of the other of the first and second through-holes.

More specifically, according to the features of one preferable embodiment, the first engaging portion of the nose is a recessed portion having side walls on which the first through-holes are opened, while the second engaging portion of the magazine is a protruding portion across which the second through-hole is opened. The protruding portion of the magazine has a configuration just fitting to the recessed portion of the nose. The second through-hole opened across the magazine is large in diameter, larger than the first through-hole opened on the side walls of the recessed portion of the nose. Furthermore, a ring-shaped elastic member is provided along an inside wall of the second through-hole of the magazine. The inner hole of the elastic member has a diameter smaller than a diameter of the first through-hole opened on the side walls of the recessed portion of the nose. The pin has both ends each formed into a stepped-up portion larger in diameter than the inner hole of the elastic member, thereby preventing the pin from moving in a thrust direction. Moreover, a gap is provided between the elastic member and the second through-hole so as to allow the elastic member to expand flexibly therein.

Furthermore, according to the features of another preferred embodiment, it is desirable that the pin is a spring pin elastically deformable in its radial direction for engaging the magazine with the nose. In this case, the first through-hole opened on the nose has the same size as the second through-hole opened on the magazine.

Still further, according to the features of still another preferred embodiment, it is desirable that the first engaging portion of the nose is a protruding portion across which the first through-hole is opened, while the second engaging portion of the magazine is a recessed portion having side walls on which the second through-holes are opened. The protruding portion of the nose has a configuration just fitting to the recessed portion of the magazine. The first through-hole opened across the nose has a diameter larger than that of the second through-hole opened on the side walls of the recessed portion of the magazine. A ring-shaped elastic member is provided along the inside wall of the first through-hole of the nose, an inner hole of the elastic member has a diameter smaller than a diameter of the second through-hole opened on the side walls of the recessed portion of the magazine. The pin has both ends each formed into a stepped-up portion larger in diameter than the inner hole of the elastic member, thereby preventing the pin from moving in a thrust direction. A gap is provided between the elastic member and the first through-hole so as to allow the elastic member to expand flexibly therein.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
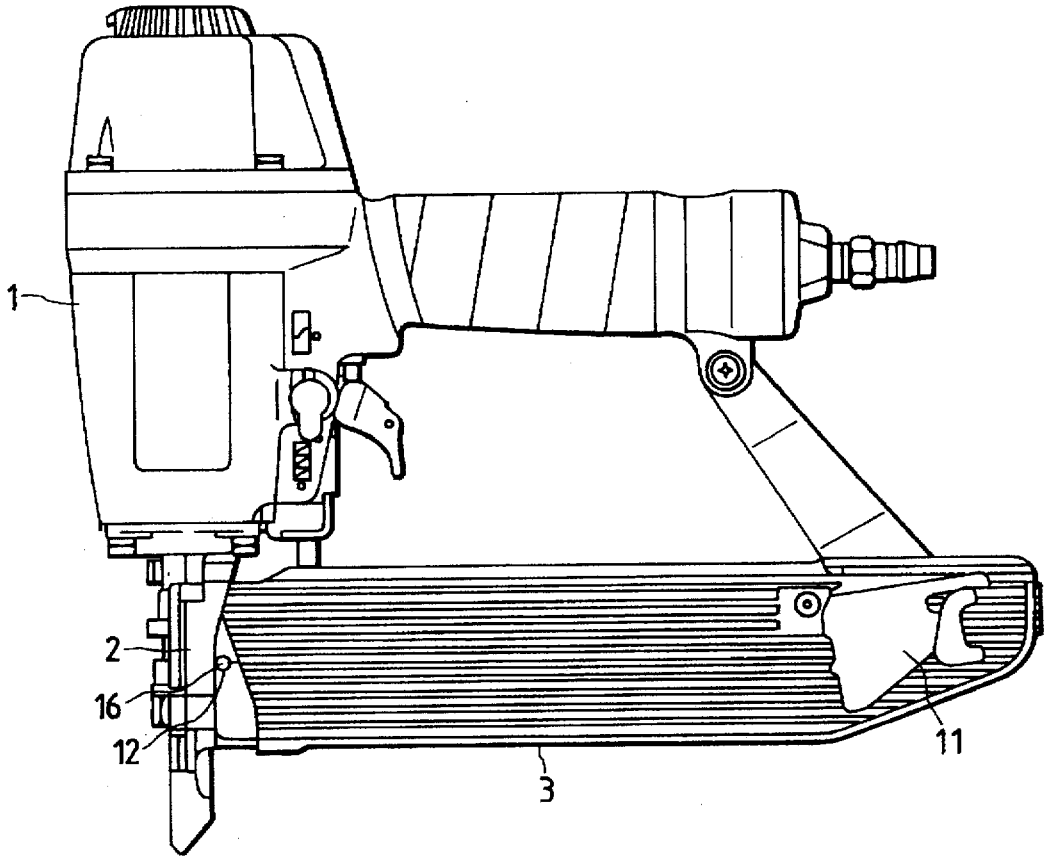
FIG. 1 is a front view showing a magazine support structure for a staple tacker in accordance with a first embodiment of the present invention.

Preferred embodiments of the present invention will be explained in greater detail hereinafter, with reference to the accompanying drawings. Identical parts are denoted by an identical reference numeral throughout views.

FIG. 1 shows a magazine support structure for a staple tacker in accordance with a first embodiment of the present invention. In FIG. 1, a feeder 11 is placed at its retracted position. A staple tacker 1 has a nose 2 extending from a front end thereof. Through nose 2, a staple is struck on a flooring material or the like to fix it. A magazine 3, supported between nose 2 and a rear end of a grip of staple tacker 1, stores a bunch of serially connected staples therein, and supplies the staples one after another to a predetermined position of the nose 2 by the function of feeder 11.

Nose 2 has a recessed or concave portion 4, serving as a first engaging portion of the present invention, for receiving a front end of magazine 3. On each of parallel, triangular side walls of the recessed portion 4 of nose 2, there is opened a through-hole 12, serving as a first through-hole of the present invention, for inserting a-pin 16 across the recessed or concave portion 4 formed inside the nose 2.

Figure 2:
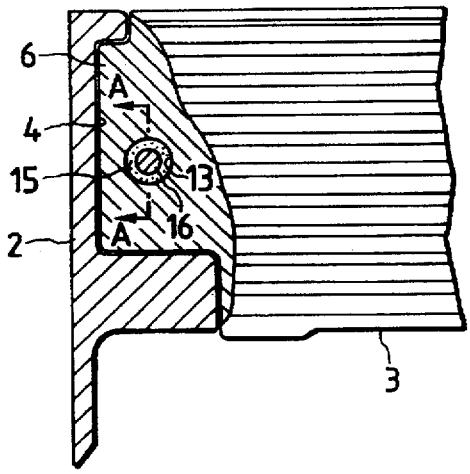
FIG. 2 is an enlarged partial sectional view showing an essential part of FIG. 1.

As shown in FIG. 2, the front end of magazine 3 has a protruding or convex portion 6 serving as a second engaging portion of the present invention. The protruding portion 6 of the magazine 3 has a configuration just fitting to the recessed portion 4 of the nose 2. Furthermore, a through-hole 13, serving as a second through-hole of the present invention, is opened across the protruding portion 6 of magazine 3 so that it just meets the through-holes 12 formed on the side walls of the recessed portion 4 of nose 2 when the front end (i.e. projecting portion 6) of magazine 3 is completely inserted into the recessed portion 4 of nose 2.

Figure 3:
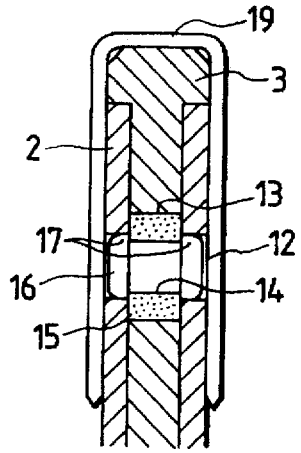
FIG. 3 is a cross-sectional view taken along a line A—A of FIG. 2.
Figure 4:
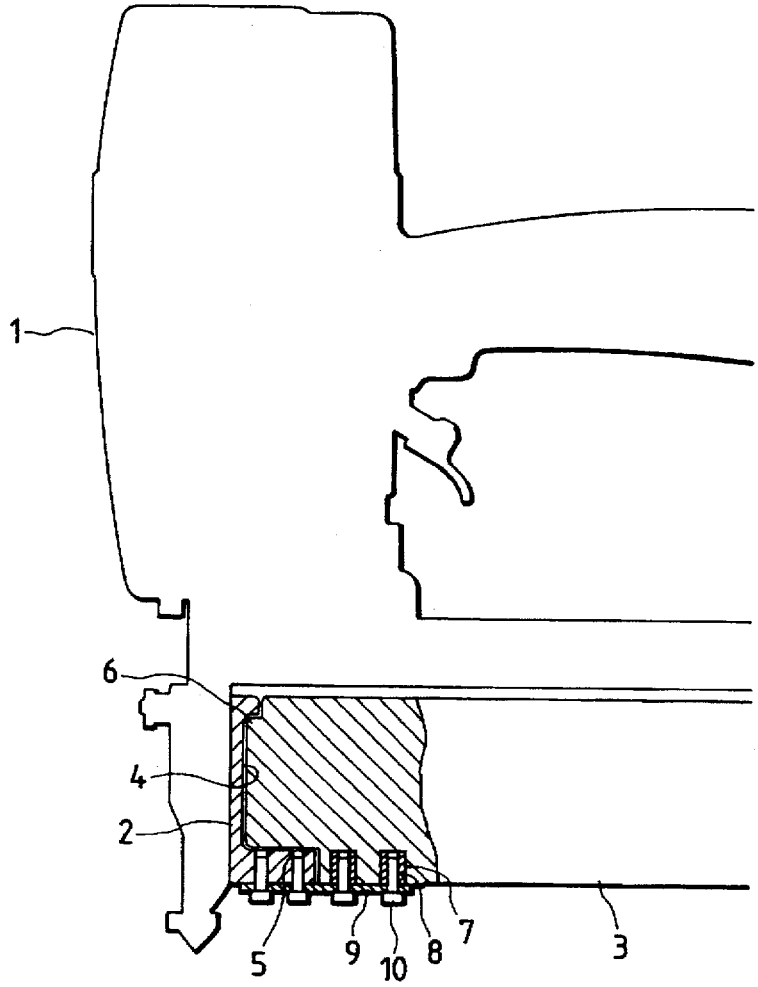
FIG. 4 PRIOR ART
FIG. 4 is a partial sectional view showing a conventional magazine support structure for a staple tacker.

As shown in FIG. 3, through-hole 13 has a diameter larger than that of through-holes 12 opened on the side walls of the recessed portion 4 of nose 2. An elastic member 15 is provided along the circumferential, circular, inside wall of through-hole 13 of magazine 3. The elastic member 15 is formed into a ring shape having an outer diameter slightly smaller than that of through-hole 13, providing a gap between elastic member 15 and through-hole 13 so as to allow the elastic member 15 to expand flexibly therein. Inner hole 14 of elastic member 15 has a diameter slightly smaller than the diameter of the through-holes 12 opened on the side walls of recessed portion 4 of nose 2.

Magazine 3 is engaged with nose 2 by the pin 16 crossing the through-holes 12 of nose 2 and the inner hole 14 of the elastic member 15 coupled in the through-hole 13 of magazine 3.

The pin 16 has both ends each formed into a stepped-up portion 17 larger in diameter than the inner hole 14 of elastic member 15. Diametral relationship among through-holes 12, through-hole 13, elastic member 15 and pin 16 effectively prevents the pin 16 from moving in the thrust direction. Furthermore, provision of elastic member 15 is effective to absorb the impact force caused in the striking operation of each staple 19.

Figure 5:
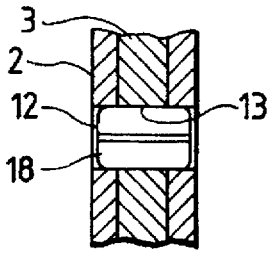
FIG. 5 is a cross-sectional view showing an essential part of a magazine support structure in accordance with a second embodiment of the present invention, similar to FIG. 3.

FIG. 5 is a cross-sectional view showing an essential part of a magazine support structure in accordance with a second embodiment of the present invention, similar to FIG. 3.

According to the second embodiment, there is provided a spring pin 18 elastically deformable in the radial direction for engaging magazine 3 with nose 2, instead of using elastic member 15 and pin 16 of the first embodiment. The arrangement of the second embodiment is identical with the first in other respects.

In this case, the diameter of through-hole 13 is identical with that of through-holes 12 opened on the side walls of nose 2. Thus, both nose 2 and magazine 3 can be brought into contact with the spring pin 18 at their through-holes 12 and 13, respectively.

Figure 6:
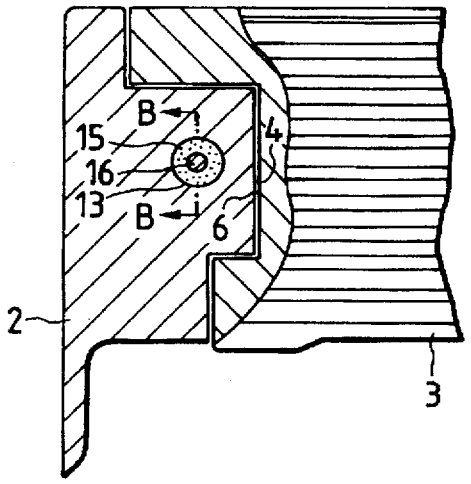
FIG. 6 is an enlarged partial sectional view showing an essential part of a magazine support structure in accordance with a third embodiment of the present invention.

FIG. 6 is a partial sectional enlarged view showing an essential part of a magazine support structure in accordance with a third embodiment of the present invention.

The third embodiment is similar to the first embodiment in the components adopted therein but is opposite in the engaging relationship between nose 2 and magazine 3.

Magazine 3 has a recessed or concave portion 4 at the front end thereof, serving as the second engaging portion of the present invention, for receiving a rear end of nose 2. On each of parallel, triangular side walls of the recessed magazine 3, there is opened a through-hole 12, serving as the second through-hole of the present invention, for inserting a pin 16 across the recessed or concave portion 4 of magazine 3.

Figure 7:
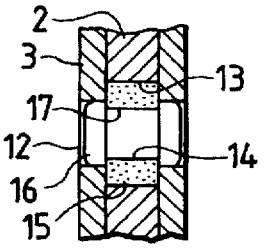
FIG. 7 is a cross-sectional view taken along a line B—B of FIG. 6.

As shown in FIG. 6, the rear end of nose 2 has a protruding or convex portion 6 serving as the first engaging portion of the present invention. The protruding portion 6 of the nose 2 has a configuration just fitting to the recessed portion 4 of the magazine 3. Furthermore, a through-hole 13 serving as the first through-hole of the present invention is opened across the protruding portion of nose 2 so that it just meets the through-holes 12 formed on the side walls of the recessed portion 4 of magazine 3 when the rear end (i.e. projecting portion 6) of nose 2 is completely inserted into the recessed portion 4 of magazine 3. As shown in FIG. 7, through-hole 13 has a diameter larger than that of through-holes 12 opened on the side walls of the recessed portion 4 of magazine 3. An elastic member 15 is provided along the circumferential, circular, inside wall of through-hole 13 of nose 2. The elastic member 15 is formed into a ring shape having an outer diameter slightly smaller than that of through-hole 13, providing a gap between elastic member and through-hole 13 so as to allow the elastic member 15 to expand flexibly therein. Inner hole 14 of elastic member 15 has a diameter slightly smaller than that of the diameter of the through-holes 12 opened on the side walls of the recessed front end portion 4 of magazine 3.

Magazine 3 is engaged with nose 2 by the pin 16 crossing the through-holes 12 of magazine 3 and the inner hole 14 of the elastic member 15 coupled in the through-hole 13 of nose 2.

The pin 16 has both ends each formed into a stepped-up portion 17 larger in diameter than the inner hole 14 of elastic member 15. Diametral relationship among through-holes 12, through-hole 13, elastic member 15 and pin 16 effectively restricts the pin 16 from moving in the thrust direction. Furthermore, provision of elastic member 15 is effective to absorb the impact force caused in the striking operation of each staple 19.

Figure 8:
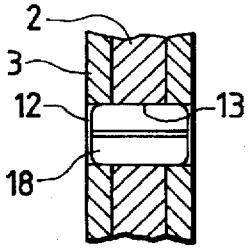
FIG. 8 is a cross-sectional view showing an essential part of a magazine support structure in accordance with a fourth embodiment of the present invention, similar to FIG. 7.

FIG. 8 is a cross-sectional view showing an essential part of a magazine support structure in accordance with a fourth embodiment of the present invention, similar to FIG. 7. According to the fourth embodiment, there is provided a spring pin 18 elastically deformable in the radial direction for engaging magazine 3 with nose 2, instead of using elastic member 15 and pin 16 of the third embodiment. In other respects the fourth embodiment is identical with the third embodiment.

In this case, the diameter of through-hole 13 is identical with that of through-holes 12 opened on the side walls of the recessed portion 4 of magazine 3. Thus, both the magazine 3 and the nose 2 can be brought into contact with the spring pin 18 at the through-holes 12 and 13, respectively.

As apparent from the foregoing description, the present invention provides a reliable magazine support structure for a staple tacker comprising a nose extending from a main body of the staple tacker for guiding a staple, and a magazine used for storing staples therein having one end connected to the nose and the other end connected to the main body of the staple tacker. The nose is provided with a first engaging portion and a first through-hole. The magazine is provided with a second engaging portion and a second through-hole. The first and second through-holes are met when the first and second engaging portions are completely engaged with each other. The magazine is fixed to the nose by inserting a pin into the first and second through-holes.

Hence, it becomes possible to decrease the number of parts to be assembled. Assembling and disassembling operations can be easily performed due to the number of parts effectively reduced.

Furthermore, according to the preferred embodiments, an elastic member is provided in at least one of the first and second through-holes for absorbing the impact force caused in each striking operation of staples, omitting the steel sleeves integrally formed with the resin body of the conventional magazine. This brings the merit of eliminating the complicated manufacturing processes for molding or inserting steel sleeves in resin for forming the magazine body used in the conventional staple tacker. No necessity of integrating steel sleeves into the resin body of the magazine is of course advantageous in view of the collection of classified refuse, as well as realization of enhancement of the productivity.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A magazine support structure for a staple tacker comprising:

a nose extending from a main body of the staple tacker for guiding a staple;

a magazine used for storing staples therein, having one end connected to said nose;

a first engaging portion and a first through-hole formed on said nose;

a second engaging portion and a second through-hole formed on said magazine, said second engaging portion being engaged with said first engaging portion of said nose, and said second through-hole meeting said first through-hole of said nose when said first engaging portion is engaged with said second engaging portion;

an elastic member in at least one of said first and second through holes; and a pin detachably inserted into said first and second through-holes so as to fix said magazine to said nose.

2. The magazine support structure defined by claim 1, wherein said pin is inserted in a hole of said elastic member, said hole of the elastic member is smaller in diameter than each of said first and second through-holes.

3. The magazine support structure defined by claim 1, wherein said first engaging portion of said nose is a recessed portion having side walls on which said first through-holes are provided, while said second engaging portion of said magazine is a protruding portion across which said second through-hole is provided.

4. The magazine support structure defined by claim 3, wherein said protruding portion of said magazine has a configuration just fitting to the recessed portion of said nose.

5. The magazine support structure defined by claim 3, wherein said second through-hole extending across said magazine is larger in diameter than said first through-hole extending through said side walls of said recessed portion of said nose.

6. The magazine support structure defined by claim 5, wherein a ring-shaped elastic member is provided along an inside wall of said second through-hole of said magazine, an inner hole of said elastic member has a diameter smaller than a diameter of said first through-hole on said side walls of the recessed portion of said nose.

7. The magazine support structure defined by claim 6, wherein said pin has both ends each formed into a stepped-up portion larger in diameter than said inner hole of said elastic member, thereby preventing said pin from moving in a thrust direction.

8. The magazine support structure defined by claim 6, wherein a gap is provided between said elastic member and said second through-hole so as to allow said elastic member to expand flexibly therein.

* * * * *